US008408135B2

(12) United States Patent
Greene

(10) Patent No.: US 8,408,135 B2
(45) Date of Patent: Apr. 2, 2013

(54) APPARATUS AND METHOD FOR A LOW FRAGMENT EXPLOSIVE ACCESS TOOL USING ONE PIECE OF EXPLOSIVE SHEET IN THE FORM OF A SIMPLE GEOMETRIC SHAPE, A BOOSTER CHARGE OF EXPLOSIVE SHEET IN THE FORM OF A DISK, A BLASTING CAP, AND INERT MATERIALS

(76) Inventor: Michael L. Greene, Fort Washington, MD (US)

( * ) Notice: Subject to any disclaimer, the term of this patent is extended or adjusted under 35 U.S.C. 154(b) by 772 days.

(21) Appl. No.: 12/082,252

(22) Filed: Apr. 11, 2008

(65) Prior Publication Data

US 2012/0210899 A1 Aug. 23, 2012

Related U.S. Application Data

(60) Provisional application No. 60/926,190, filed on Apr. 26, 2007.

(51) Int. Cl.
*F42B 1/02* (2006.01)

(52) U.S. Cl. ..... 102/301

(58) Field of Classification Search ..... 102/305, 102/301, 314, 318, 322, 331, 332, 403; 86/50
See application file for complete search history.

(56) References Cited

U.S. PATENT DOCUMENTS 291,606 A * 1/1884 Knox ..... 299/13
3,076,408 A * 2/1963 Poulter et al. ..... 89/1.14
3,090,306 A * 5/1963 Reuther ..... 102/403
3,280,743 A * 10/1966 Reuther ..... 102/305
3,374,737 A * 3/1968 Pike ..... 102/275.5
3,439,408 A * 4/1969 Bergmann et al. ..... 228/107
4,044,599 A * 8/1977 Goldstein et al. ..... 73/12.11
4,408,535 A 10/1983 Alford
5,149,911 A * 9/1992 Ringbloom et al. ..... 102/302
6,220,166 B1 * 4/2001 Cherry ..... 102/305
6,817,297 B1 11/2004 Greene et al.
6,865,990 B1 3/2005 Greene et al.
6,966,263 B1 * 11/2005 Greene et al. ..... 102/309

OTHER PUBLICATIONS

Davis, Tenny L, The Chemistry of Power and Explosives, Hollywood: Angrief Press, 1943, (ISBN-0913022-00-4), pp. 16-18; 20.
Walters, W.P. and Zukas, J.A., Fundamentals of Shape Charges, New York: Wiley-Interscience, 1988, (ISBN 0-471-62172-2), pp. 45-71.
Greene, Michael L., "X-Cutter a Do-It-Yourself Explosive Tool." The Detonator, vol. 33, No. 2, Mar./Apr. 2006, pp. 60-61.
Varwig, Robert L., "Initiation Requirements and Performance of the Diamond Charge, a Flat Flexible Demolition Charge." NAVORD RPT 5734, White Oak, 1957, 4p.

* cited by examiner

*Primary Examiner* — Bret Hayes
*Assistant Examiner* — Reginald Tillman, Jr.

(57) ABSTRACT

Apparatus and method for an explosive access tool using one piece charge of explosive sheet in the form of a simple geometric shape, a disk shaped booster charge, a blasting cap, and inert materials. The one piece charge of explosive sheet, envelopes an inert tamper block with its apexes meeting on the top side of the block facing away from the target. A smoothing layer, preferably in a mostly square shape, is placed between the target and the explosives covering the bottom side of the tamper block. An initiating means is connected to the apexes of the explosive charge so that upon initiation, a series of detonation waves are generated to meet in a manner that result in a plurality of petals cantilevered that are formed in the target material, substantially between the intersections of the meeting shock waves, to define a near fragment-free opening in the target material.

14 Claims, 10 Drawing Sheets

APPARATUS AND METHOD FOR A LOW FRAGMENT EXPLOSIVE ACCESS TOOL USING ONE PIECE OF EXPLOSIVE SHEET IN THE FORM OF A SIMPLE GEOMETRIC SHAPE, A BOOSTER CHARGE OF EXPLOSIVE SHEET IN THE FORM OF A DISK, A BLASTING CAP, AND INERT MATERIALS

CROSS-REFERENCE TO RELATED APPLICATIONS

This nonprovisional utility application claim the benefits of Provisional Patent Application No. 60/926,190 with a filing date of Apr. 26, 2007.

STATEMENT REGARDING FEDERALLY SPONSORED RESEARCH OR DEVELOPMENT

This invention was made under federally sponsored research and development and entitles the federal government to royalty free rights.

BACKGROUND OF THE INVENTION

The present invention pertains to the field of producing near fragment-free access openings, more particularly to the field of using explosive materials that produce near-fragment free openings in hardened structures such as metal shipping containers and most particularly to the field of using explosive material to produce near-fragment free openings in hardened containers that house agents or substances that must not be overly disturbed.

Bomb squad technicians regularly deal with packages that need to be opened for immediate inspection or remotely in locations where heavy cutting tools may not be assembled or time is of the essence. In order to reduce the risks associated with opening such packages, technicians primarily use either robotic tools or explosive access tools that can be initiated from a distance. For certain types of packages or containers, robotic access tools, which often lack precision, power, and are cumbersome, cannot be employed. For these types of packages, such as sea-land containers, metal drums, or other hardened containers, explosive access tools are the only option.

Various explosive tools have been employed for this purpose. One technique is to employ a linear shaped charge to create an opening in the hardened container. These shaped charges comprise a chevron shaped metallic casing, which is usually copper, aluminum, or lead, that contains a quantity of high explosives. The charge cuts the hardened container by accelerating each side of the chevron shaped wedge into each other, forming a high velocity metal jet. However, this technique, like merely using high explosives to directly cut into hardened targets, produces many fragments, which are capable of overly disturbing the contents within the container.

In order to alleviate this fragmentation problem, a device commonly know as the Magic Cube™ was developed and disclosed in U.S. Pat. No. 6,220,166. This device comprises a sheet explosive that is initiated at four different points and a buffer material, made up of three sheets of stacked, low density material, such as polyethylene foam which is placed between the explosive and the target. Various types of tapes and adhesives are required in order to combine these elements and affix the final device to the target. While the device does alleviate the fragmentation problem discussed above under certain circumstances, it does have several problems associated with its intended use. First, due to the complexity of the device, any particular embodiment is designed to operate on only one range of specific wall thickness. Second, also due to the complexity of the device, it is relatively expensive.

Another device commonly known as the X-Cutter™ was developed, disclosed and claimed in U.S. Pat. No. 6,865,990 to alleviate the fragmentation problem. This device comprises a flexible material, preferably in a mostly square shape, having substantially orthogonal grooves scored into one side. An explosive charge, usually in the form of sheet explosives, is cut to fit the side opposite the grooves, in substantially the same shape as the grooves, without extending beyond the periphery of the flexible material. An initiating means is connected to the explosive charge so that upon initiation, the grooves focus the explosive charge so that a plurality of petals cantilevered from the target plate are formed in the target material, substantially between the ends of the grooves, to define a fragment-free opening in the target material. Again, this device does alleviate the fragmentation problem discussed above under most conditions, but it does not have the simplicity of fabrication of the invention herein presented. The X-Cutter™ needs the grooves to be placed in the flexible material in a machine shop.

Therefore, it is desired to provide an explosive access tool that produces little fragmentation, is inexpensive, simple to fabricate, and can be used on containers made of steel, having various shapes and of varying wall thickness.

BRIEF SUMMARY OF THE INVENTION

The present invention comprises a simplified explosive access tool used by bomb squad technicians and others who require immediate and/or remote access to suspect packages and containers. The invention solves several problems associated with current tools along with the using of explosive materials carried by many bomb squad technicians in the field.

Accordingly, it is an objective of this invention to provide an explosive access tool that creates near fragment-free openings in target materials.

It is a further object of this invention to provide an explosive access tool that can be employed on magnetic targets made of steel without the use of adhesives, tapes, or bonding agents.

A further object of this invention is to provide an explosive access tool that is inexpensive compared to present explosive access tools.

A yet further object of this invention is to provide explosive access tools that can be employed on targets of varying wall thickness with the same amount of explosives.

This invention accomplishes these objectives and other needs related to creating a near fragment-free openings in target materials by providing a device that uses a flexible magnetic sheet material to help form a tamper block in the shape of a simple geometric form, a square, the first embodiment of this invention, or an isosceles triangle, the second embodiment of this invention, and a separate smoothing layer comprised of a single lamina of said flexible material and of said form. An explosive charge, usually in the form of a sheet of explosives, is cut in the projected shape of two flat geometrical diamonds or equilateral quadrilaterals that have been centrally rotated ninety degrees with respect to one another in their geometrical plane for the square tamper block, and an isosceles triangle of sheet explosives for the triangular tamper block. These explosive charges are wrapped around the aforementioned respective tamper blocks to allow their apexes to meet centrally above the top side of the tamper block. A booster charge consisting of a small disc of sheet explosives is placed centrally upon the top of the apexes. This assembly is placed atop a smoothing layer of flexible material in the respective shape of a square or triangle but extending out from the periphery of the tamper block and sheet explosive wrapping. The bottom side of the smoothing layer interfaces with the target. An initiating means is connected proximately centrally to the explosive booster charge that produces a plurality of shock waves that are simultaneously formed at the apexes of the square or triangular formed sheet explosives. These shock waves meet along straight lines that centrally meet on the bottom side of the tamper block. The meeting of the shock waves fault or fracture the steel target below in a pattern that allows the shock and blast that is attenuated through the smoothing layer to open a plurality of petals cantilevered from the target material and define a near fragment-free opening in the target material. When more energy is imparted into these petals from the explosive sheet by those skilled in the knowledge of the invention described herein with regard to the mass of the tamper block and thickness of the smoothing layer, the petals may be made to tear further back into the target material and open further beyond the initial fault or fracture lines without fragmenting or breaking off, and without changing the quantity of explosive sheet.

Finally, the invention also comprises a method of using the device described herein to create an opening in a target material.

BRIEF DESCRIPTION OF THE SEVERAL VIEWS OF THE DRAWING

The accompanying drawings, which are incorporated in and constitute a part of the specification, illustrate embodiments of the invention, and together with the description, serve to explain the principles of the invention.

DETAILED DESCRIPTION OF THE INVENTION

Figure 1:
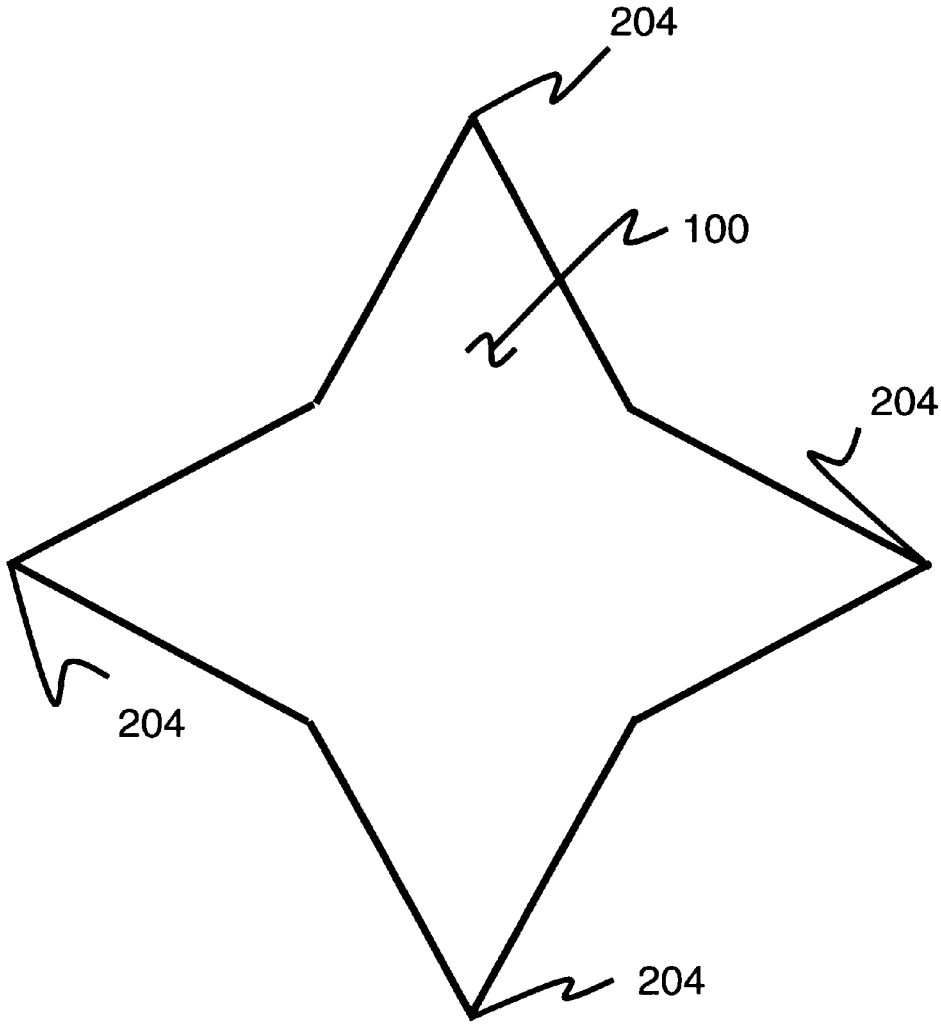
FIG. 1 is a top view of one side of the primary embodiment of the present invention.

The invention, as embodied herein, comprises an explosive access tool used to create near fragment free openings in target materials, often the walls of packages or containers that need to be opened for immediate inspection or remotely in locations where heavy cutting tools may not be assembled. The elements of the tool are made up of one piece of explosive sheet in the form of a simple geometric shape, a booster charge of explosive sheet in the form of a disc, a blasting cap, and inert materials. The inert materials comprise a tamper block assembly, a smoothing layer, and a blasting cap holder means. The tamper block assembly has two flat parallel surfaces, a top and a bottom, comprised of flexible sheet material and a filler material between the two exterior flat surfaces of flexible sheet material that may consist of additional flexible sheet material, laminas of thin cardboard, or other low density material. This block serves to: 1) position the one piece of explosive sheet in the form of a simple geometric shape to undergo simultaneous detonation of its disparate apexes, and 2) act as a tamper that will enhance the breaching capability of said explosive sheet positioned below the bottom side of the tamper block. Another piece of inert flexible material is placed between one side of the explosive sheet and the target material. This piece of inert flexible material will be referred to as a smoothing layer. This layer prevents spall and fragmentation in the target material. The smoothing layer is larger in area than the explosive sheet that would interface with the target in the absence of the smoothing layer. A booster charge in the shape of a disc of explosive sheet is place centrally on top of the point at which the apexes of the explosive sheet meet on the top side of said tamper block. The booster charge assures simultaneous detonation of the apexes of the explosive sheet. Initiating means are connected proximately central to the booster charge in order to initiate the explosives. A blasting cap holder means aligns the blasting cap central to the booster charge. The arrangement of said explosive sheet, booster charge, and inert materials allows the shock waves generated from the disparate apexes of the explosive sheet to collide in the explosive sheet facing the target in a cruciform configuration for the first embodiment of this invention and a "y" configuration for the second embodiment of this invention. The result in a faulting or fracture of the target in such a manner to allow petals cantilevered from the target material as in a blooming flower to form and produce an aperture in the target material with minimal fragmentation.

The elements of the tool are made of materials, many of which are already carried by bomb squad technicians that are relatively inexpensive and light weight. In general, the invention comprises a flexible material that is used as both a smoothing layer and tamper with regards to the explosive charge. The term flexible, as it is used in this application, refers to a non-rigid material, capable of being flexed without the use of outside tools or machinery. Therefore, steel based materials would not be flexible, but materials such as polymeric materials or rubber materials would be flexible. An example of such a material is a flexible magnetic sheet material that is a magnetic powder material placed into a thermoplastic base material manufactured by Magnum Magnetics Corporation. This material provides the necessary mass to act as an excellent tamper. Further, the material acts as an excellent smoothing layer and is very frangible, a property that does not produce large and dangerous fragments. This material is manufactured with a 2 mil layer of vinyl on its top or bottom surface that may be used for graphics and printing as explained later in this specification.

Figure 2:
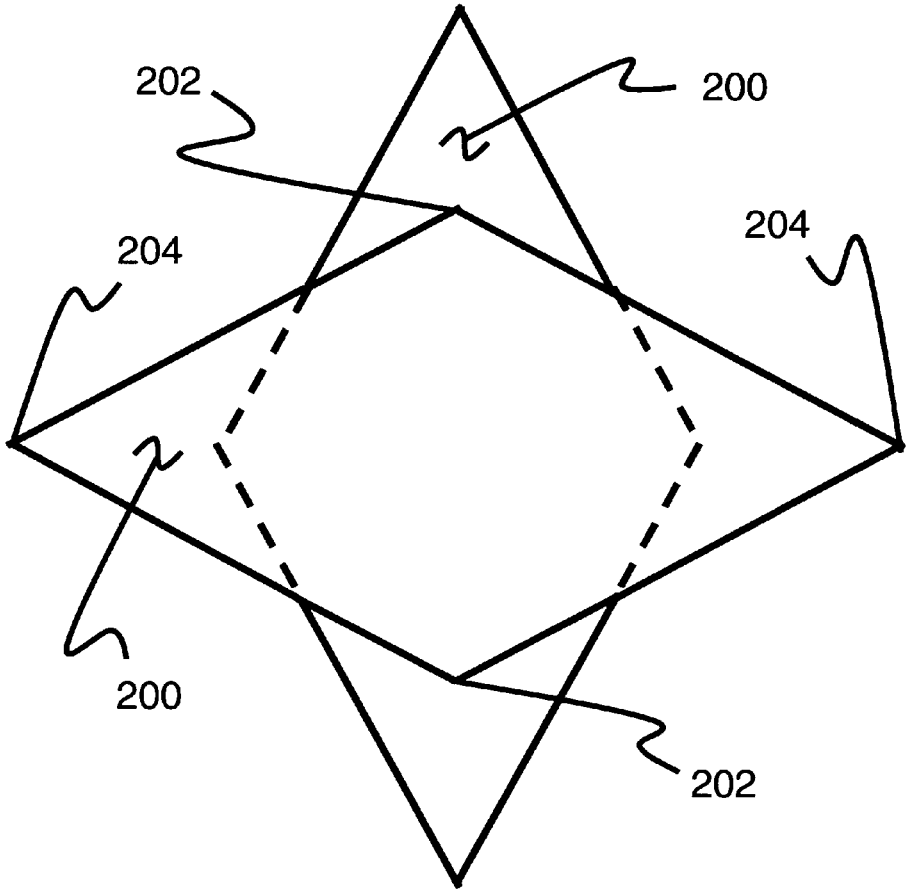
FIG. 2 is a top view of the geometric shapes set forth in FIG. 1.

Referring to FIGS. 1 and 2 of the first embodiment of this invention, the explosive sheet material 100 is in the projected shape of two flat geometric diamond shapes 200 that have been laid over one another in a geometric plane and rotated 90 degrees about their centroid with respect to one another. The Diamond Charge 200 to those skilled in the art of demolition is used to cut steel pipe by inducing tensile fractures through the interaction of two colliding shock wave fronts from an explosive charge of sheet explosive when simultaneously detonated at opposite ends. The opposite ends that are simultaneously initiated are the apexes 202 at the short axis of the diamond that is parallel to the long axis of the pipe when the long axis of the diamond with apexes 204 is wrapped around the pipe. The long axis of the diamond charge is equal to the circumference of the pipe to be cut.

Referring to FIG. 1, the explosive charge 100 has four apexes 204 that are equidistant from the centriod of the area of the explosive sheet material. When the four apexes 204 are simultaneously initiated, the four colliding shock wave fronts induce tensile fractures in the shape of a cruciform in a target material. The explosive charge 100 can be selected by one skilled in the art based upon the amount of force desired by the user of the device. Preferably, the explosive charges 100 will be in the form of a sheet explosive that can be cut to a desired size. A preferred type of explosive material comprises pentaerythritol tetranitrate (PETN). Exemplary explosive charges 100 are 0.043 inch thick and 0.083 inch thick PETN sheet explosives manufactured by E.I. DuPont. This explosive sheet material is also referred to as Detasheet.

Figure 3:
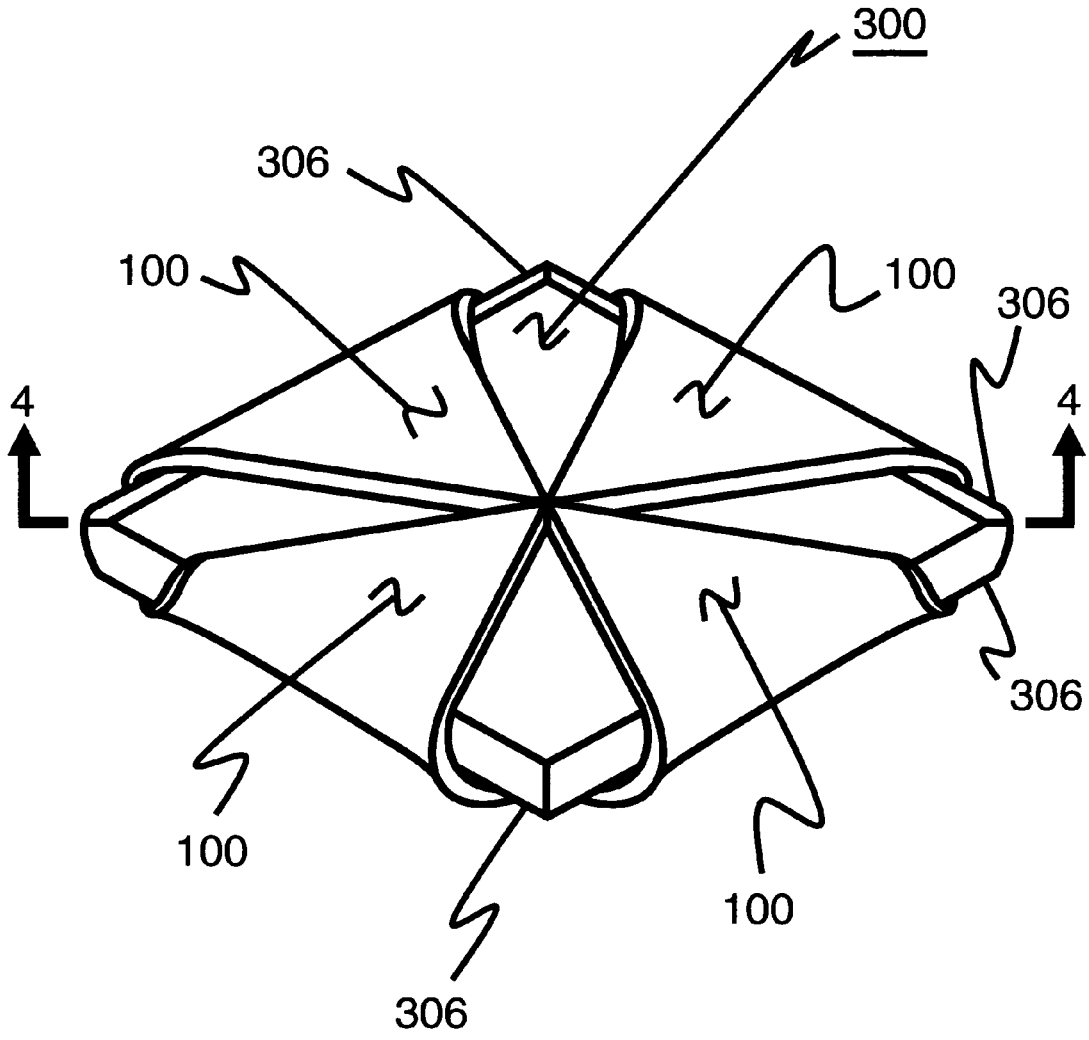
FIG. 3 is a top view of one side of the primary embodiment of the present invention.
Figure 4:
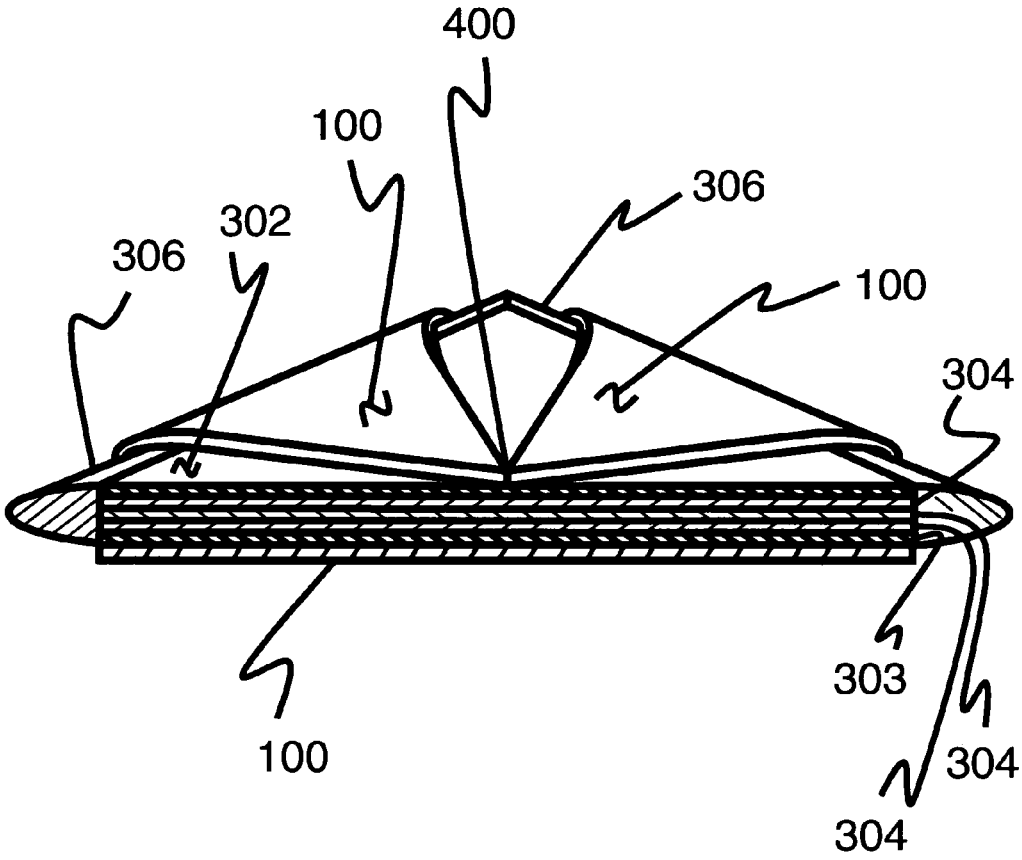
FIG. 4 is a cross-section view of FIG. 3 along section 4-4.

Referring to FIGS. 3 and 4, the explosive charge 100 is wrapped around flat block 300 having two sets of parallel sides, a top 302 and bottom 303, of square pieces of flexible sheet material filled with additional laminas 304 of square pieces of: flexible sheet material, cardboard, or other low density material. The mass of this block is important because it acts as a tamper that controls the effectiveness of the energy delivered from the explosive sheet in accordance with the Gurney Equations. Therefore, one skilled in the art may adjust the cutting ability of the explosives without adding additional explosives. The block also serves as a form to hold the explosive sheet material in the correct position to effect simultaneous ignition of the four apexes at centrally located point 400 atop parallel side 302. As part of this form, four pieces of mitered half-round wooden molding 306 surrounds the four edges of the block. The laminas and molding are held in place by a suitable adhesive that is not shown. If the explosive access tool herein described is not pre-assembled by a manufacturer, but assembled from its inert and explosive sheet components and assemblies in the field, block 300 will be marked with pre-printed positioning guide-lines that are not shown on its top surface of sheet material 302 to assure that the four apexes 204 are wrapped around said block with their apexes meeting at the center of top square of flexible sheet material 302. This will also assure that the block is not assembled up-side-down, because the internal laminas 304 in block 300 may not be of the same material in the immediate vicinity of the bottom lamina of flexible magnetic material as the top lamina 302 of flexible magnetic material. Changing a lamina next to the bottom lamina 303 from a lower density to a higher density has much more effect on the cutting ability of this tool than changing a lamina next to the top lamina 302 from a lower density to a higher density. Therefore, block 300 may have different tamper effects if turned upside down. These effects may be used to advantage when this tool is assembled in the field. The same tamper block 300 may be used against two different target thicknesses that depend on the up and down orientation of tamper block 300. When the assembly 300 and explosive charge 100 are entirely pre-assembled in a factory, these two parts may be held together by an adhesive or suitable low-fragmenting type packaging that are not shown herein.

Figure 5:
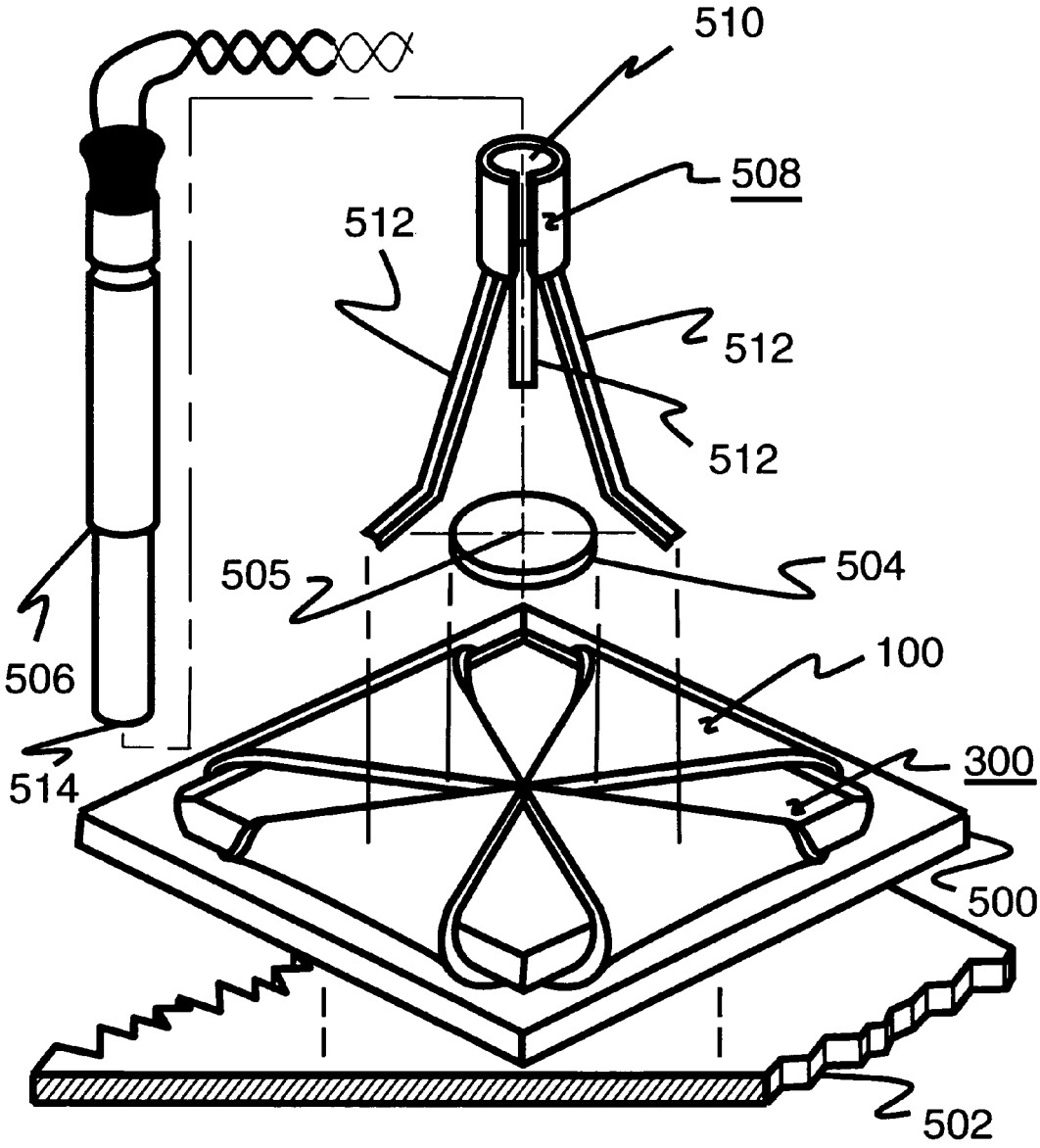
FIG. 5 is an exploded top view of the primary embodiment set forth in FIG. 4.

Referring to FIGS. 4 and 5, the invention includes a smoothing layer of flexible magnetic material 500 that attenuates the shock effect between explosive charge 100 and the target 502 to prevent spall and fragmentation. The thickness of this layer may be adjusted in combination with the additional adjustment of the mass of tamper layers 304 of block 300 to effectively produce a near fragment-free aperture in target 502. Changing tamper layers 304 from low density cardboard to high density flexible magnetic material in the immediate vicinity of bottom tamper layer 303 has a dramatic effect on the breaching efficiency of this invention in accordance with the teachings of the Gurney Equations. The area of the smoothing layer is greater than the area of the explosive charge that would normally contact the target if the smoothing layer were not in place and is centrally located directly under the explosive charge 100 facing the target. The smoothing layer 500 is shown as a square piece of material, but other geometric shapes are possible. The smoothing layer 500 sits directly atop the target 502. The assembly 300, explosive charge 100, and smoothing layer 500 may be held together in the field with tape not shown. When the invention is assembled in a factory, an adhesive or packaging material that is not shown may be employed to hold the said assembly and components together. The magnetic properties of the smoothing layer will hold the invention in contact with a steel target 502 without the use of adhesives or tape.

Referring to FIGS. 1 and 5, a booster charge 504 of explosive sheet material in the shape of a disc is centrally placed atop the four apexes 204 of explosive charge 100 to assure the four apexes 204 initiate simultaneously when wrapped around tamper block 300. When the initiating means 506 is activated, booster charge 504 that is part of the explosive train subsequently initiates explosive charge 100 to create a meeting of shock waves that will fault or fracture said target 502 after passing through smoothing layer 500. The subsequent blast of explosive charge 100 will open the target material along the fracture or fault lines to create a plurality of petals cantilevered from the target material as in a blooming flower. The initiating means 506 may comprise any type of explosive initiator that will reliably initiate the type of explosive material used as booster charge 504. Preferably, the initiating means will be located approximately in the center 505 of booster charge 504. One preferred initiating means comprises an electric blasting cap because such a device is standard equipment in a bomb disposal technician's kit. The invention may also include a blasting cap holder means 508 of thin steel and approximately 2.25 inches long and 0.30 inch in diameter. The holder consists of a C-shaped trough 510 and three supporting legs 512. The legs 512 are bendable to assure the center of trough 510 will align the output end 514 of blasting cap 506 centrally with the top of booster charge 504. Blasting cap holding means 508 is standard equipment of a bomb disposal technician's kit and may be held in place with tape (not shown) when assembled in the field. When the invention is assembled in a factory, an adhesive or packaging material that is not shown may be employed to hold the blasting cap in position. Further, said blasting cap may be replaced by other ignition means, for example, an exploding bridge wire (EBW) detonator that may be shipped as one unit with the explosive components of this invention in place when duly qualified in accordance with hazard classification regulations.

In a preferred embodiment of this invention it was found that an explosive charge of 0.083 inch thick Detasheet with distances that are referred to in FIG. 2 between apexes 204 of 5.60 inches and virtual apexes 202 of 3.11 inches, when wrapped around a block 300 with 2 inch square laminas, a top and bottom piece, of 0.060 inch thick flexible magnetic material with a 0.02 inch thick coating of white vinyl facing out and fillers of cardboard laminas between the non vinyl sides of said flexible material, totaling ½ inch in overall thickness that is surrounded by ½ inch round wooden molding, said explosive charge produced an aperture through which an 8 inch diameter volley ball would pass in a section of 2 millimeter thick Cor-ten steel that is used in the construction of sea-land shipping containers. The distance between apexes 204 of 5.60 inches is slightly greater than the perimeter of the minimal cross sectional area of block 300 that passes through the centroid of the block and normal to parallel sides 302 and 303. A MK II MOD 0 blasting cap 506 and booster charge 504 of 0.083 inch thickness and ¾ inch diameter are used to initiate explosive sheet 100. A 3 inch square piece of said flexible material is used as the smoothing layer 500.

Figure 6:
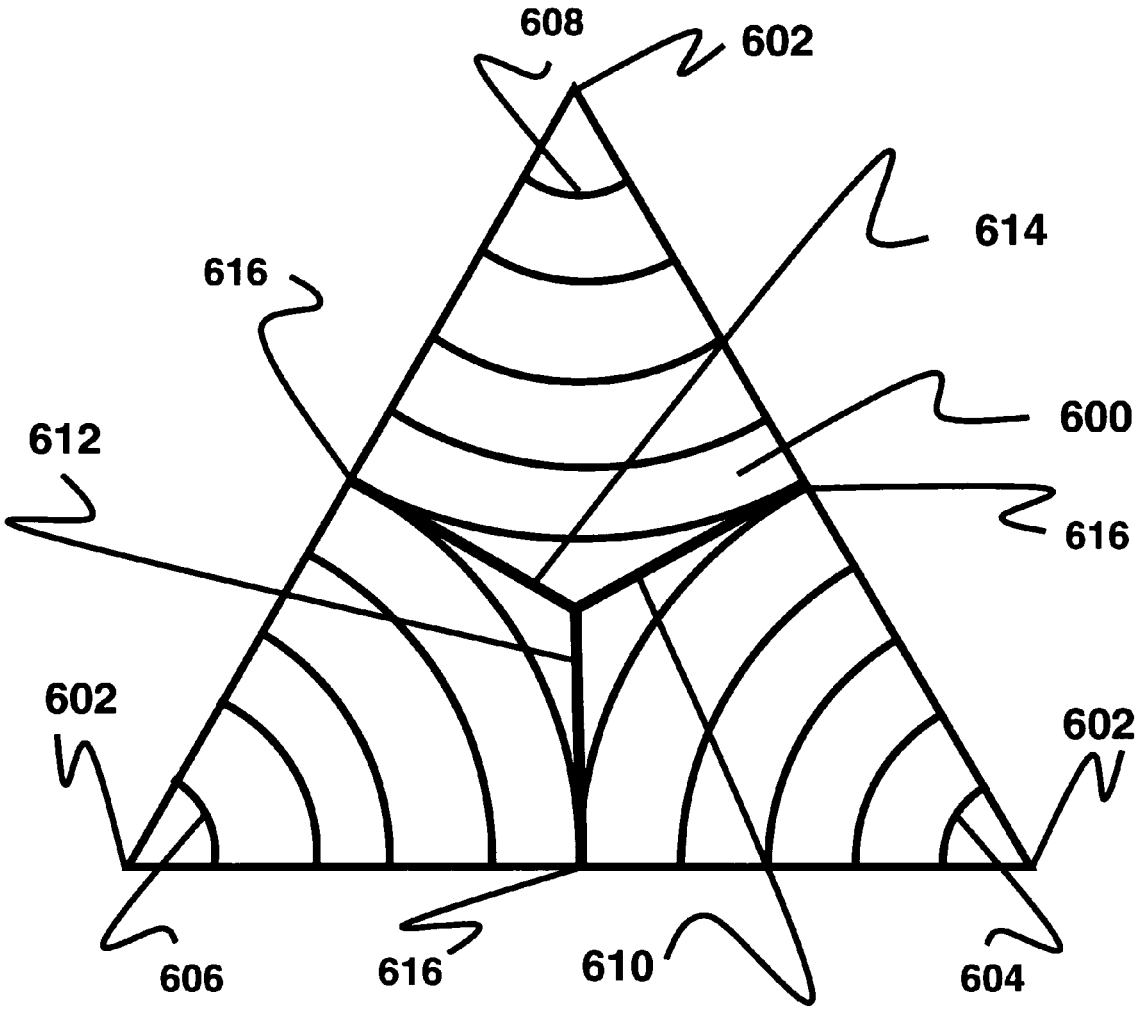
FIG. 6 is a top view of one side of the secondary embodiment of the present invention.

Referring to FIG. 6, yet a second embodiment of the invention is presented. This embodiment of the invention is shown primarily in FIG. 6, an explosive sheet 600 in the shape of an isosceles triangle with apexes 602. When the three apexes are simultaneously initiated, expanding shock waves 604, 606, and 608 will be produced. Shock waves 604, 606, and 608 will meet on lines 610, 612, and 614 in a "y" configuration that will be employed to produce fault lines or fractures in a metal plate when arranged in accordance to the teachings herein. These fault lines or fractures in a metal plate will permit said plate to form petals cantilevered from the target plate that open as the petals of a blooming flower and produce a near fragment-free opening. Advantages of explosive sheet 600 vice explosive sheet 100 as shown in FIG. 1 are that the shock waves generated from the three disparate apexes 602 meet head-on at midpoints 616 along the sides of said sheet and meet at greater head-on angles than the four apex configuration of explosive sheet 100. One skilled in the art of fracturing steel plates in half with colliding shock waves that are produced by sheet explosives, e.g., Detasheet, will design a device to generate shock waves that meet in a more head-on manner within said explosive sheet to produce a better line-of-cut.

Figure 7:
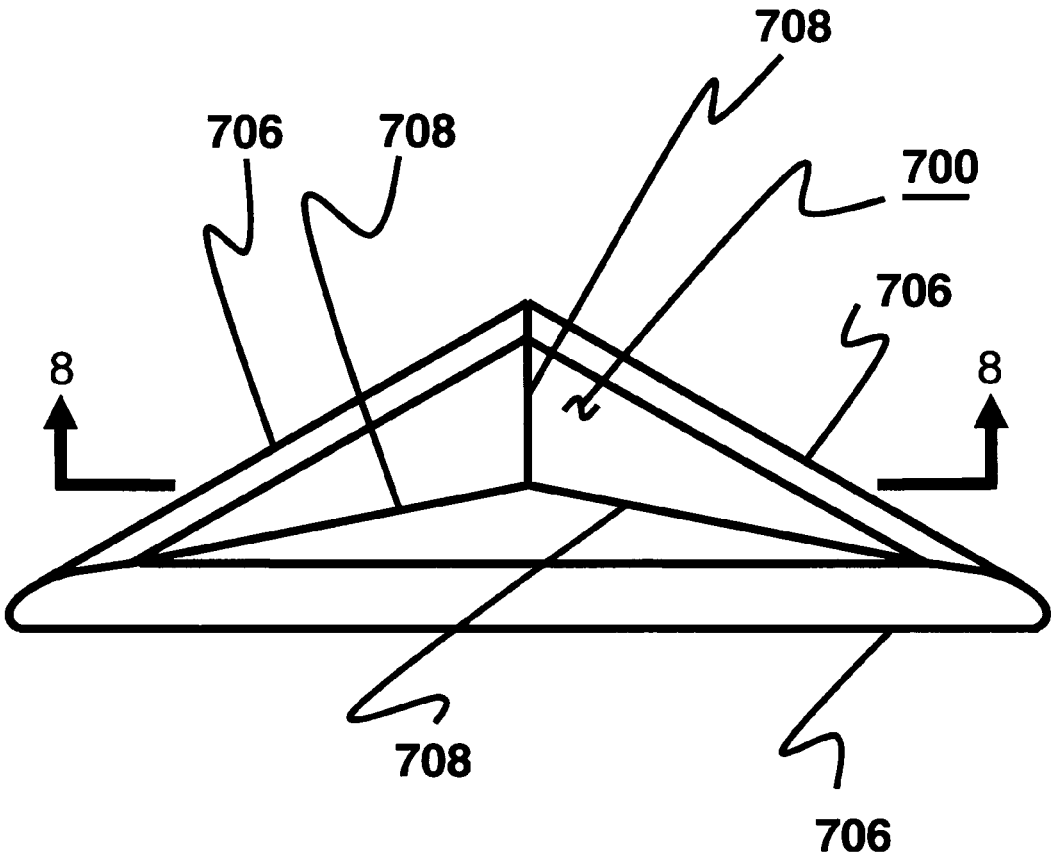
FIG. 7 is a top view of one side of the secondary embodiment of the present invention.
Figure 8:
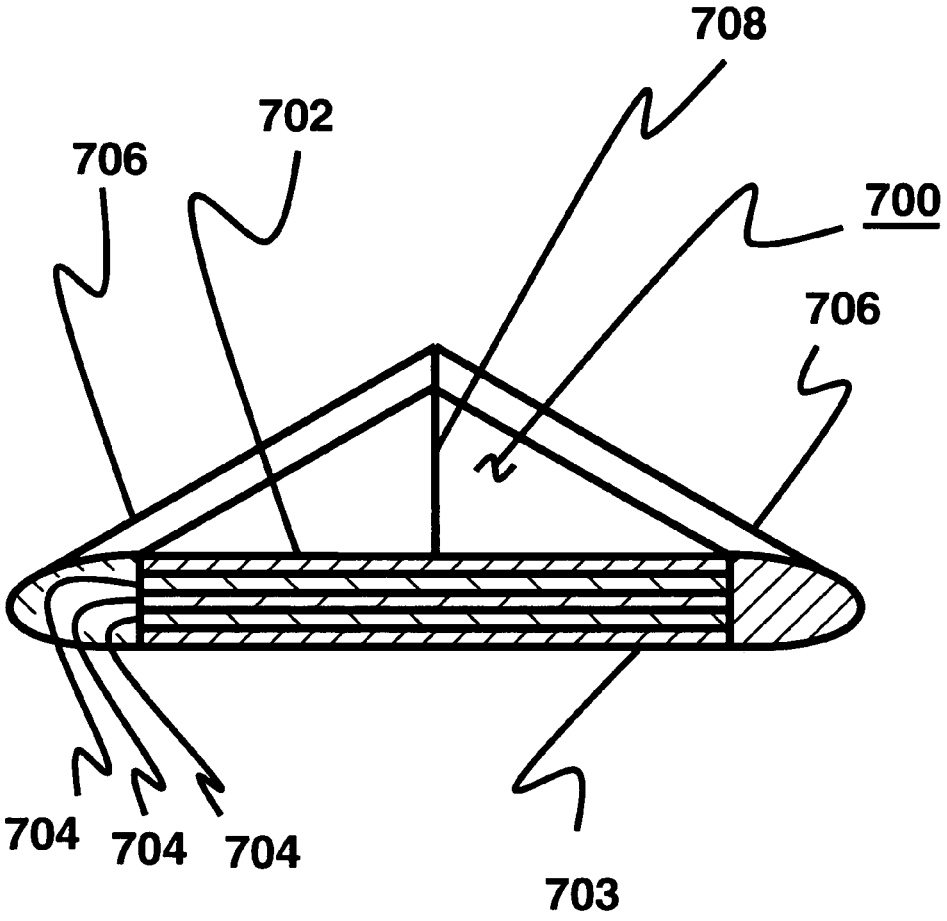
FIG. 8 is a cross-section view of FIG. 7 along section 8-8.

Referring to FIGS. 7 and 8, a flat block 700 in the shape of an isosceles triangle has two sets of parallel sides, a top 702 and bottom 703, of triangular pieces of flexible sheet material filled with additional laminas 704 of triangular pieces of: flexible sheet material, cardboard, other low density material, or a combination thereof. The tamper block 700 is constructed of identical materials to that used to construct tamper block 300 as shown in FIG. 4.

Figure 9:
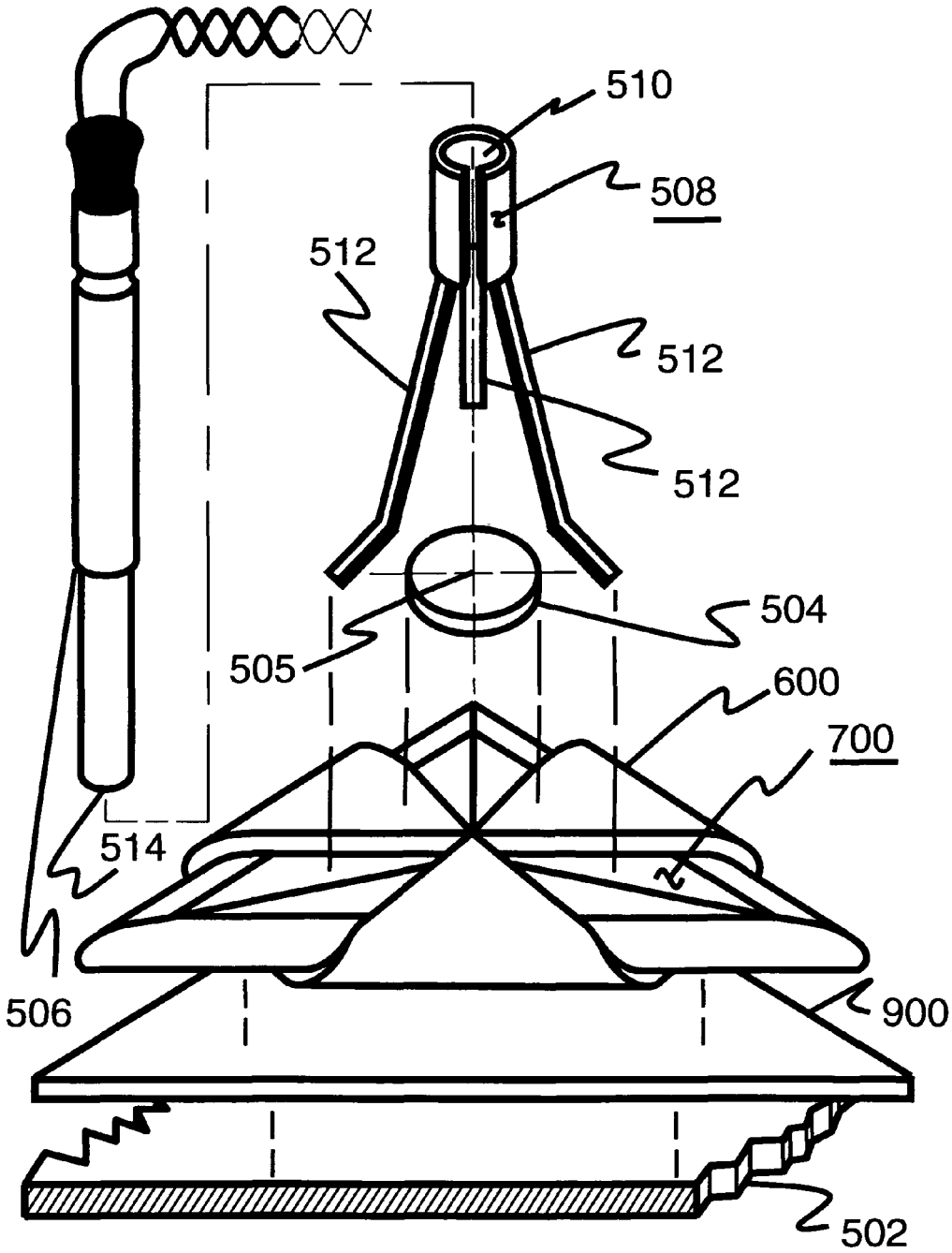
FIG. 9 is an exploded top view of the secondary embodiment set forth in FIG. 7.

Referring to FIGS. 4, 7, 8, and 9, the FIG. 8 cross-section of block 700 along section 8-8 shows laminas 702, 703, and 704 that correspond to the FIG. 4 laminas 302, 303, and 304 of block 300. In accordance with previous teachings herein, the mass of this block is important because it acts as a tamper that controls the effectiveness of the energy delivered from the explosive sheet in accordance with the Gurney Equations. Therefore, one skilled in the art may adjust the cutting ability of the explosives without adding additional explosives by adjusting its mass, especially the mass immediately adjacent to explosive sheet 600 that faces the target 502. The block also serves as a form to hold the explosive sheet material 600 in the correct position to effect simultaneous ignition of the three apexes as shown in FIG. 9. As part of this form, three pieces of mitered half-round wooden molding 706 surround the three edges of the block. These laminas and molding are held in place by a suitable adhesive that is not shown. When the explosive access tool herein described is not pre-assembled by a manufacturer, but assembled from its inert and explosive sheet components and assemblies in the field, block 700 will be provided with pre-printed positioning guide-lines 708 on its top surface of flexible sheet material 702 to assure that the three apexes 602 as shown in FIG. 6 are wrapped around said block with their apexes meeting at the center of the top side of flexible sheet material 702. For field assembly, block 700 may also be marked with pre-printed position guide-lines (not shown) on its bottom surface of sheet material 703 as previously taught to adjust the cutting ability when said block is turned upside down. When the assembly 700 and explosive charge 600 are entirely pre-assembled in a factory, these two parts may be held together by an adhesive or suitable low-fragmenting type packaging that are not shown herein.

Referring to FIG. 9, isosceles triangular shaped sheet explosive 600 is shown wrapped around tamper block 700. The length of a side of sheet explosive 600 will be approximately 1.5 times the length of the side of laminas 702, 703, or 704 that are all isosceles triangles with identical side lengths. A smoothing layer 900 with an area greater than the area of the explosive charge that would normally contact the target if the smoothing layer were not in place and is centrally located under the explosive charge 600 facing the target. The smoothing layer 900 is shown as an isosceles shaped piece of material, but other geometric shapes are possible. The smoothing layer 900 material is identical in thickness and composition to smoothing layer 500. The assembly 700, explosive charge 600, and smoothing layer 900 will be held in place with tape (not shown) or other previously stated means (not shown) herein. The magnetic properties of the smoothing layer that is composed of flexible magnetic sheet will hold the invention in contact with a steel target 502 without the use of additional adhesive or tape. Again, initiating means consisting of blasting cap 506 that is held in place by the trough 510 of blasting cap holder 508 with bendable legs 512 to align centrally the output end 514 of said blasting cap against the center 505 of booster charge 504 will effect the detonation of explosive sheet 600 via simultaneous detonation of its three disparate apexes. Upon detonation of explosive sheet 600 that is wrapped around tamper block 700, the meeting of generated shock waves in explosive sheet 600 will result in a cutting through smoothing layer 900 to fault and fracture target plate 502 in a "y" configuration as taught in FIG. 6. The additional blast and shock from said explosive sheet will be attenuated by smoothing layer 900 to create a plurality of petals cantilevered from the target material as in a blooming flower to form a near fragment-free opening in target 502 along the fault and fracture lines in target plate 502.

Figure 10:
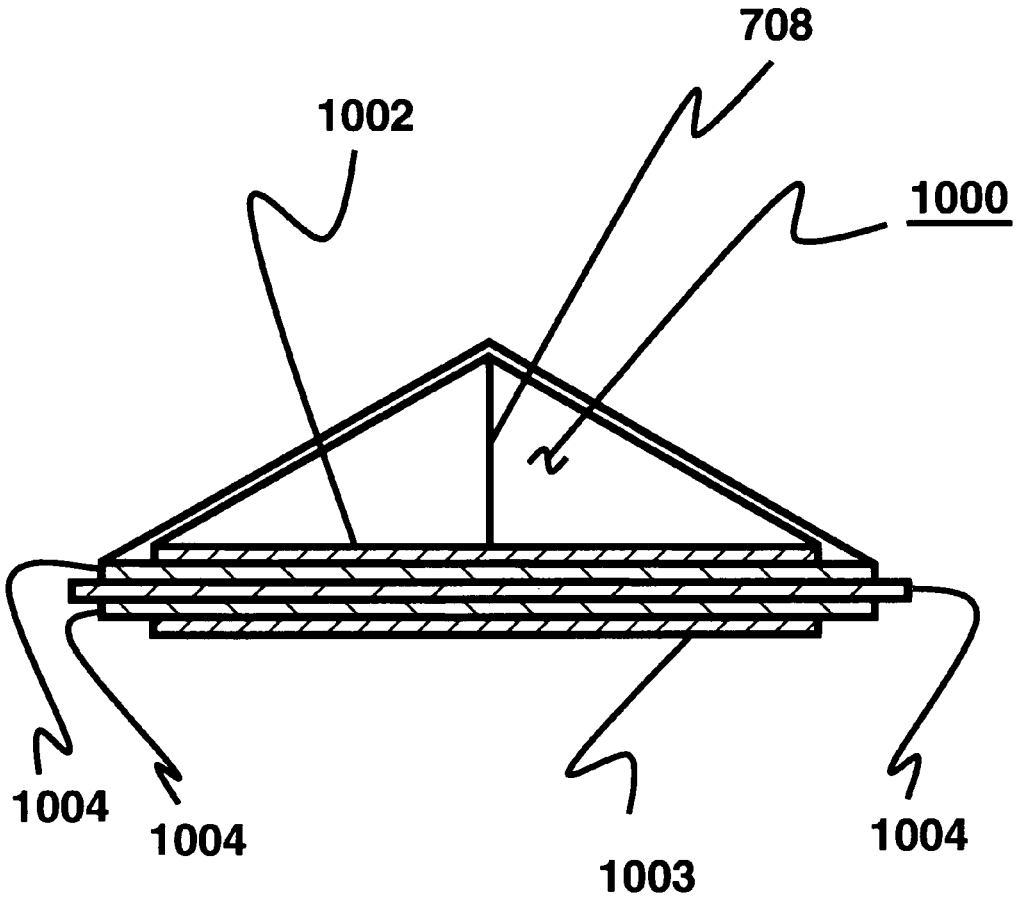
FIG. 10 is a separate embodiment of the cross section view of FIG. 8.

Referring to FIG. 10, a separate embodiment is shown of the cross-section view of FIG. 8. A tamper block 1000 is comprised of laminas 1002, 1003, and 1004 that correspond to FIG. 8 laminas 702, 703, and 704 that are all isosceles triangles in shape. These laminas 1002, 1003, and 1004 are of the same materials and thickness as laminas 702, 703, and 704, but have adjusted areas to approximate the outer curved periphery of wooden moldings 706 of FIG. 7. Elimination of wooden moldings 706 will simplify field assembly of block 700 because there are fewer components. Again, block 1000 will be provided with pre-printed positioning guide-lines 708 on its top 1002 and/or bottom 1003 surfaces of flexible magnetic material for field assembly. An adhesive to keep laminas 702, 703, and 704 in positions is not shown.

The invention also includes method of creating near fragment free openings in target materials using the above described invention.

What is described are specific examples of many possible variations on the same invention and are not intended in a limiting sense. The claimed invention can be practiced using other variations not specifically described above.

What is claimed is:

1. A device for creating an opening in a target material, comprising:

a total of eight layers of material, with at least one layer of flexible magnetic sheet material with a specific gravity between 3.3 and 3.7, and sheet material with a specific gravity of less than 0.8, all sheets of 0.055 to 0.065 inch thickness, symmetric geometry, and symmetrically placed atop one another;

an explosive charge of a single piece of sheet explosives with symmetric convex vertices wrapped symmetrically around said layers of sheet material;

a smoothing layer disposed below said sheet explosives and above the target;

and, initiating means, located proximately central to and atop the explosive charge, to initiate the explosive sheet creating an explosive force, wherein the explosive force, guided by said charge geometry and mass of said flexible magnetic sheets and sheets of lesser specific gravity, penetrates the target material, creating a plurality of petals cantilevered from the target material, to define a fragment-free opening in the target material.

2. The device of claim 1, wherein the explosive charge comprises a Pentaerythritoltetranitrate based material in sheet form.

3. The device of claim 1, wherein the explosive charge sheet has convex vertices meet at a single point located proximately central to said top side of the eight layers of sheet material.

4. The device of claim 1, wherein the explosive charge sheet is in the form of the total projected area of a square with a side of "x" length that is common with one side of four equiangular triangles of side "x" length.

5. The device of claim 1, wherein the explosive charge sheet is in the form of an equiangular triangle.

6. The device of claim 1, wherein the flexible magnetic sheet material and sheet material of a lower specific gravity are square in shape.

7. The device of claim 1, wherein the flexible magnetic sheet material and sheet material of a lower specific gravity are of equiangular triangle shape.

8. The device of claim 1, where in the sheet materials mounted atop one another are held in place with quick drying liquid glue.

9. The device of claim 1, further comprising adhesive means to hold the device against the target material.

10. The device of claim 1, wherein the smoothing material is comprised of flexible magnetic sheet extending beyond the periphery of the explosive charge above the target.

11. The device of claim 1, wherein said initiating means includes a booster charge of explosive sheet in the shape of a disc centrally placed atop the central meeting point of the convex vertices of said explosive sheet wrapper.

12. The device of claim 1, further comprising a blasting cap in contact with the top side of said disc.

13. A method of creating an opening in a target material, comprising the steps of:

providing a total of eight layers of tamper material, with at least one layer of flexible magnetic sheet material with a specific gravity between 3.3 and 3.7, and sheet material with a specific gravity of less than 0.8, all sheets of 0.055 to 0.065 inch thickness, of symmetric geometry, and symmetrically placed atop one another;

providing an explosive charge of a single piece of sheet explosives with symmetric convex vertices wrapped symmetrically around said layers of sheet material;

providing a smoothing layer disposed below said sheet explosives and above the target; and providing initiating means, located proximately central to and atop the explosive charge, to initiate the explosive sheet creating an explosive force, wherein the explosive force, guided by said charge geometry and mass of said flexible magnetic sheets and sheets of lesser specific gravity, penetrates the target material, creating a plurality of petals cantilevered from the target material, to define a fragment-free opening in the target material.

14. A method of claim 13 wherein the explosive force delivered to the target may be changed by change of stacking position atop one another of the eight said sheets of flexible magnetic sheet material and sheet material of a lower specific gravity.

* * * * *